United States Patent [19]

Richards

[11] 4,305,586

[45] Dec. 15, 1981

[54] CASINO TYPE GAME OF CHANCE

[76] Inventor: Dennis A. Richards, 2107½ 2nd Ave., Texas City, Tex. 77590

[21] Appl. No.: 157,353

[22] Filed: Jun. 9, 1980

[51] Int. Cl.[3] ..... A63F 3/00

[52] U.S. Cl. ..... 273/274; 273/287

[58] Field of Search ..... 273/274, 292, 287

[56] References Cited

U.S. PATENT DOCUMENTS

| | | | |
|---|---|---|---|
| 3,663,021 | 5/1972 | Whippo | 273/274 X |
| 3,667,757 | 6/1972 | Holmberg | 273/285 X |
| 4,222,572 | 9/1980 | Baker | 273/274 X |

*Primary Examiner*—Anton O. Oechsle

*Attorney, Agent, or Firm*—Neal J. Mosley

[57] ABSTRACT

A casino type game of chance consists of a game board formed in two layers with elongated cubicles therebetween for receiving cards that can be mixed by a game operator and passed through to the other side to a player to select the cards for play. The surface of the game board consists of a suitable design with the months of the year arranged thereon for play using the cards. The cards consist of two sets. One set of cards consists of three cards bearing the number one and nine cards bearing the number zero. The other set of cards consists of two ones, two twos, and one each of the digits 3, 4, 5, 6, 7, 8, 9 and 0. The cards are drawn one at a time, first one from one set and then one from the other set. The combination obtained is played on the board according to the months of the year as follows: 01=January, 02=February, etc. up to 12=December. The player attempts in a series of plays to draw numbers ultimately covering all of the months of the year. Play continues until the player loses by drawing an ineligible number, i.e. a number from 13 to 19, or matches a month which he has already played. The play progresses in stages with the player being able to quit with no return or a low return in the first one or two rounds. The return on the player's stakes becomes progressively greater as he attempts to win all by covering all of the months.

10 Claims, 11 Drawing Figures

| | | | | | | | | | | | | |
|---|---|---|---|---|---|---|---|---|---|---|---|---|
| 9 | 0 | 0 | 0 | 0 | 0 | 0 | 0 | 0 | 0 | 1 | 1 | 1 |
| 10 | 1 | 2 | 3 | 4 | 5 | 6 | 7 | 8 | 9 | 0 | 1 | 2 |

CASINO TYPE GAME OF CHANCE

BACKGROUND OF THE INVENTION

1. Field of the Invention

This invention relates to new and useful improvements in casino type games of chance and more particularly to a type of game in which the return on the player's stakes becomes progressively greater as the game as the game proceeds.

2. Brief Description of the Prior Art

Casino type games of chance are well known in areas where gambling casinos have been legalized. Casino type games, as distinguished from home type individual player games, are games where an individual plays against the house and sometimes against the other players. Typical examples of casino type games are roulette, blackjack, various types of dice games, etc.

Fisher U.S. Pat. No. 1,100,869 discloses a set of numbered playing cards which are intended for individual use but could be used in a casino type game of chance.

Goldfarb U.S. Pat. No. 3,623,730 discloses a card game and method of playing the same having a tray with plurality of individual compartments containing the cards and allowing the cards to be removed and to be moved from compartment to compartment.

Breslow U.S. Pat. No. 3,734,510 discloses a game device having playing tokens played in accordance with selected master situation cards.

Barrett U.S. Pat. No. 3,747,934 discloses a novel type of dice playing apparatus.

SUMMARY OF THE INVENTION

One of the objects of this invention is to provide a new and improved casino type game of chance which is simple to manufacture and easy to learn and interesting to play.

Another object of the invention is to provide a casino type game in which the chances for gain or loss become progressively greater as the game proceeds.

Still another object of the invention is to provide a casino type game in which the player selects digits in a randomized manner to play on a board in accordance with numbers corresponding to the months of the year.

Other objects of this invention will become apparent from time to time throughout the specification and claims as hereinafter related.

The objects of this invention are realized in a new and improved casino type game as described herein. This casino type game of chance consists of a game board formed in two layers with elongated cubicles therebetween for receiving cards that can be mixed by a game operator and passed through to the other side to a player to select the cards for play.

The surface of the game board consists of a suitable design with the months of the year arranged thereon for play using the cards. The cards consist of two sets. One set of cards consists of three cards bearing the number one and nine cards bearing the number zero. The other set of cards consists of two ones, two twos, and one each of the digits 3, 4, 5, 6, 7, 8, 9 and 0. The cards are drawn one at a time, first one from one set and then one from the other set.

The combination obtained is played on the board according to the months of the year as follows: 01=January, 02=February, etc. up to 12=December. The player attempts in a series of plays to draw numbers ultimately covering all of the months of the year. Play continues until the player loses by drawing an ineligible number, i.e. a number from 13 to 19, or matches a month which he has already played. The play progresses in stages with the player being able to quit with no return or a low return in the first one or two rounds. The return on the player's stakes becomes progressively greater as he attempts to win all by covering all of the months.

DESCRIPTION OF THE PREFERRED EMBODIMENT

Figures 1, 2:
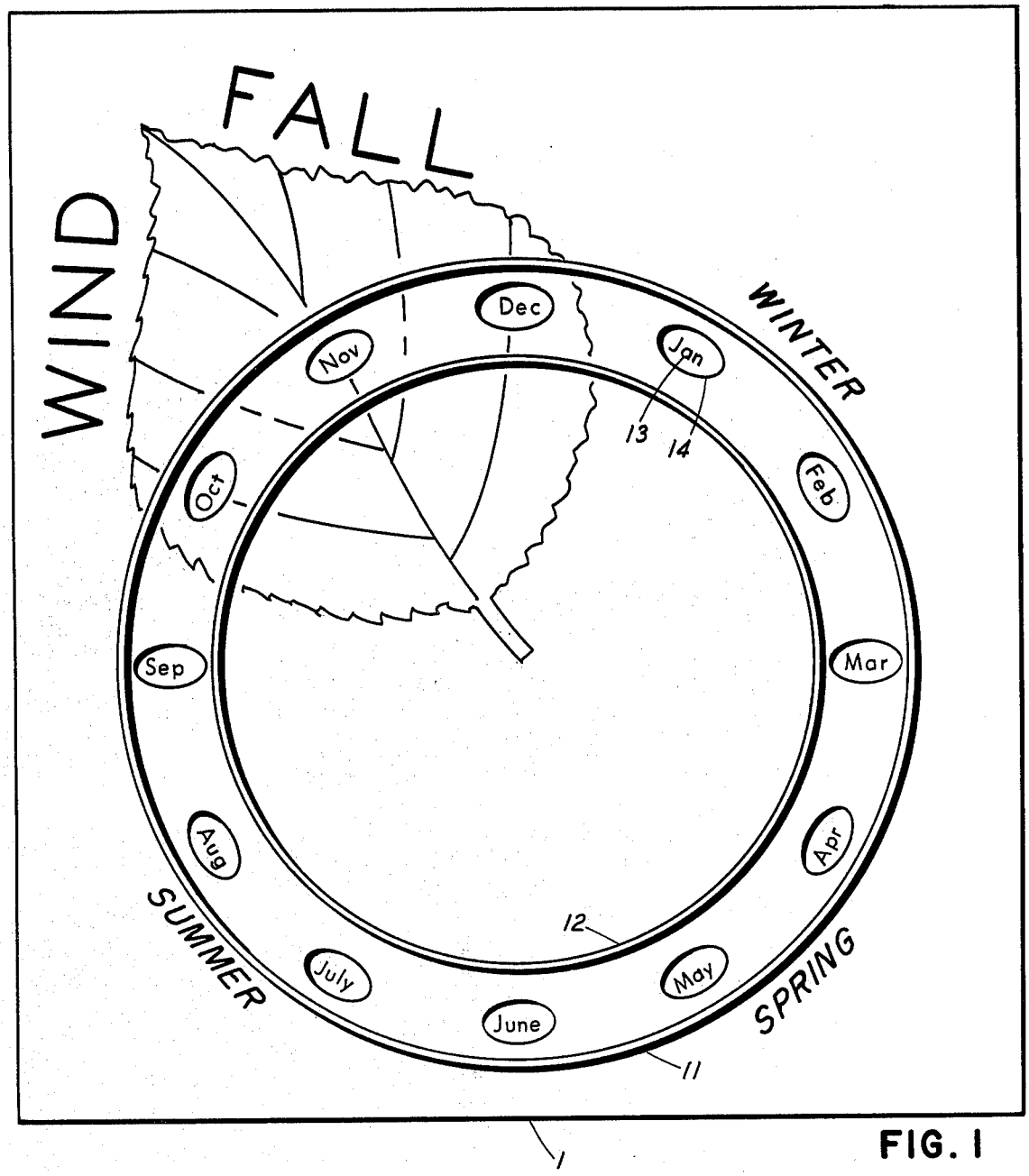
FIG. 1 is a plan view of a game board for a casino type game of chance representing a preferred embodiment of this invention.
FIG. 2 is a plan view of two sets of playing cards to be drawn at random for play of the game shown in FIG. 1.
Figure 3:
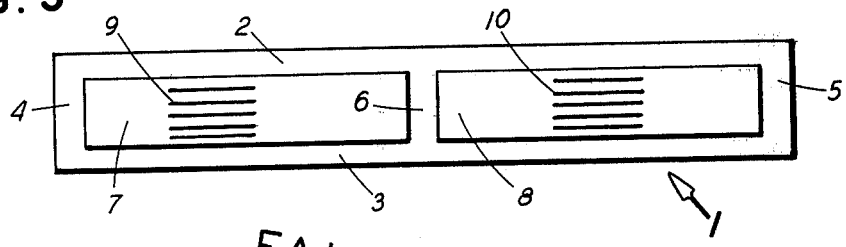
FIG. 3 is an end view of the playing board shown in FIG. 1 showing cubicles for containing the playing cards.

Referring to the drawings by numeral of reference and more particularly to FIGS. 1 and 3, there is shown a display panel or game board 1 having an upper layer or board 2, and a lower layer or board 3 and slide walls 4 and 5, as seen in FIG. 3, defining a playing board of a box like structure. An internal partition 6 extends from end to end through the playing board and defines two spaces or cubicles 7 and 8 which extend from end to end of the board. The cubicles 7 and 8 receive and hold a plurality of playing cards comprising a first set 9 and second set 10 which will be subsequently described. These sets of cards 9 and 10 are mixed or randomized and placed in cubicles 7 and 8 with their respective faces concealed. The sets of cards may be drawn and played by the player representing the house or either or both of the sets may be pushed through the cubicle to the other side so that the individual player plays both sets or plays one set of cards while the other set is played by the representative of the house. The nature of the cards and the rules of the play will be described more fully below.

In FIG. 1, it is seen that playing board 1 bares the indicia and design of the game. The game is called WINDFALL and is shown in the board as comprising a design consisting of concentric circles 11 and 12 thereon between which there are located indicia 13 enclosed in a suitable outline 14 indicating the months of the year located clockwise on the board extending from January through December. Just outside the outer circle 11 at appropriate positions on the board are indicia indicating the seasons of the year, winter, spring and summer and at one side the indicia WINDFALL.

The game is played with two sets of playings units or cards 9 and 10. The set of cards 9 consist of twelve cards consisting of nine zeros and three ones. The set of cards 10 consist of two ones, two twos and one each of the digits 3, 4, 5, 6, 7, 8, 9 and 0.

The cards from sets 9 and 10 are drawn one at a time and are played on the board as number combinations which may correspond to a month of the year according to the number sequence 01=January; 02=February; 03=March; 04=April; 05=May; 06=June; 07=July; 08=August; 09=September; 10=October; 11=November; 12=December.

In the play of the game sets 9 and 10 are separately mixed or randomized in any suitable manner and are placed in the respective cubicles 7 and 8 with the faces of the cards down in preparation for play. The cards are drawn one at a time and if the combination of a card drawn from set 9 and a card drawn from set 10 corresponds to one of the months of the year that set of cards may be played on the playing board by covering the month of the year that corresponds to the numerical combination obtained by the draw of the cards.

The play begins by the player first making his ante or bet which covers the entire play of the game. By making this play, he commits himself to a minimum of three draws. He must draw in succession three units or cards from the respective sets 9 and 10. On the first draw the player would draw one card or unit from set 9 from cubicle 7 and one card or unit from set 10 from cubicle 8. Alternatively, the draw could be made by the player for the house or separately by the player for the house and the outside player.

If for, example, the initial draw was 05 (meaning a 0 from cubicle 7 and a 5 from cubicle 8), the player would place the cards together to indicate his successful draw of a number combination and lay them in the interior of circle 12 on the playing board until his two remaining draws were made. In as much as the player has made a draw representing a month on the playing board, he is therefore entitled to make the second draw. If for, example, he draws a one from cubicle 7 and a zero from cubicle 8, this combination is the number ten which represents October. These playing cards or units would be placed together as the number represented in the center of circle 12. Since the player has again drawn a number combination corresponding to a month of the year he can advance to the third and final draw of his initial three-draw commitment. If, for example, on this draw he draws a zero from cubicle 7 and a one from cubicle 8, the combination 01 represents the month of January and is a permissible and successful draw. This combination of cards would be placed in the center of the playing circle 12.

Figure 4:
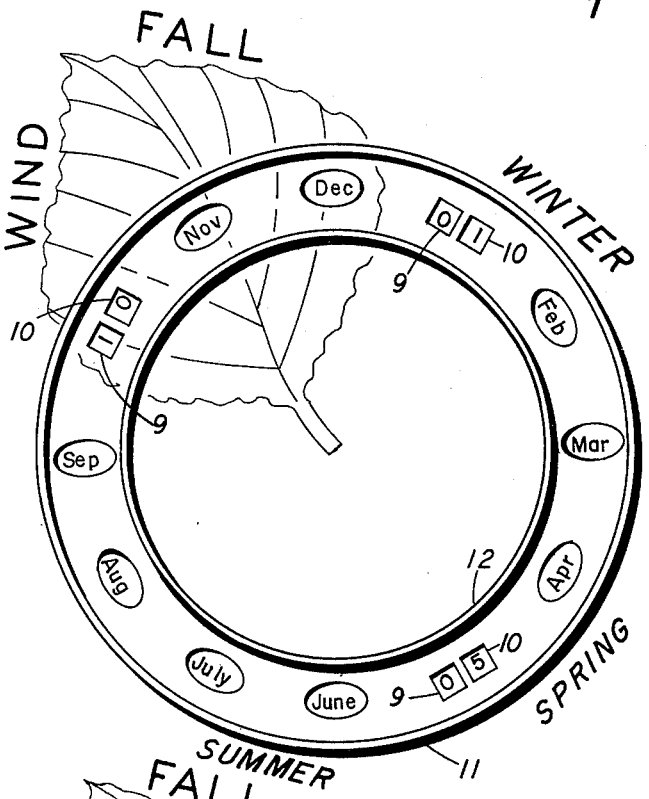
FIG. 4 is a plan view of the game board of FIG. 1 at one stage of play.

At this point, the player has completed a successful first draw round and is entitled to spot the month combinations which have been drawn in their respective places on the playing board. In this case, the player would be entitled to cover the months January, May and October, this position of play is illustrated in FIG. 4 of the drawings wherein the cards drawn from sets 9 and 10, as described above, have been placed over the enclosures 14 for the months January, May and October.

At this point in the play, the player has reached his first decision point. He has completed his first successful round. At this point he can quit the game and regain his ante with no payoff included or he can make the decision to continue the game by committing himself to go for three more draws. This decision is made with the knowledge that if he fails on any one of the three succeeding draws he looses the game which means losing the ante or bet that has been made. Most casino gamblers would not be satisfied with merely regaining their ante so the assumption is made that the player will proceed with the second round of draw.

Figure 5:
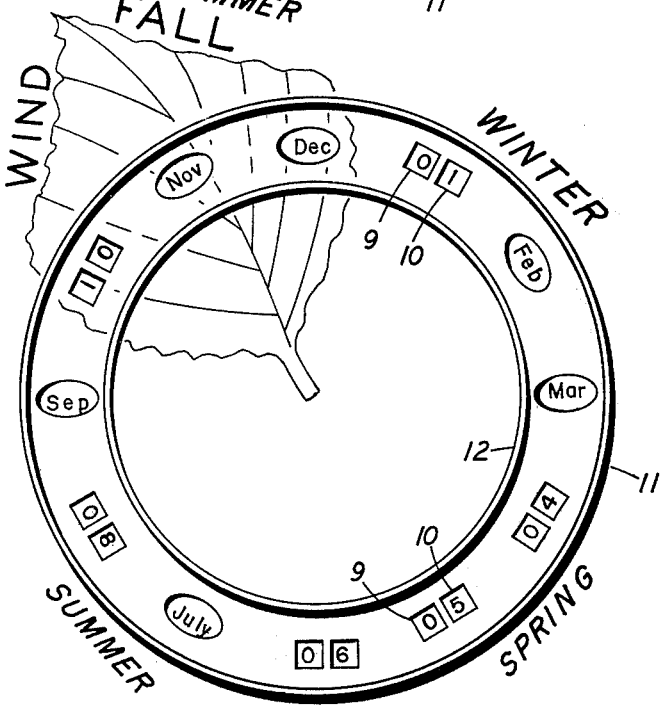
FIGS. 5 to 11, inclusive, illustrate the game as shown in FIGS. 1 and 4 at different stages in the play thereof.

In the play of this game, the payoff to the player becomes progressively greater as the play proceeds since the chances of success become progressively smaller. In the second round of play assume that the fourth draw has produced the combination 06=June; the fifth draw produced the combination 04=April; and the sixth draw produced 08=August. The player has been lucky enough to make it through the second round of the draw and may now spot the three month combinations which have just been drawn in their respective positions on the playing board. In this position the play board would appear as it is shown in FIG. 5 of the drawing.

At this point, the player is at his second decision point. The board is now half filled with six of the twelve months covered numercially. The player can quit and take the Level 6 payoff which is the minimum amount paid out or he can elect to go for three more draws in the hope of reaching this third decision point and more lucrative payoff available at that point. Before reaching this decision, the player would scan the WINDFALL (leaf-enclosed) portion to see if any of the three WINDFALL months are covered. In this case, October is covered and the other two months are open. Also, he should look at the January and February points to see if those spaces are covered or open. In this case, January is covered but February is open. A knowledgeable player who has reached this point in the game should check out the status of those points. This is very important, since it effects the likelihood of success.

Figure 6:
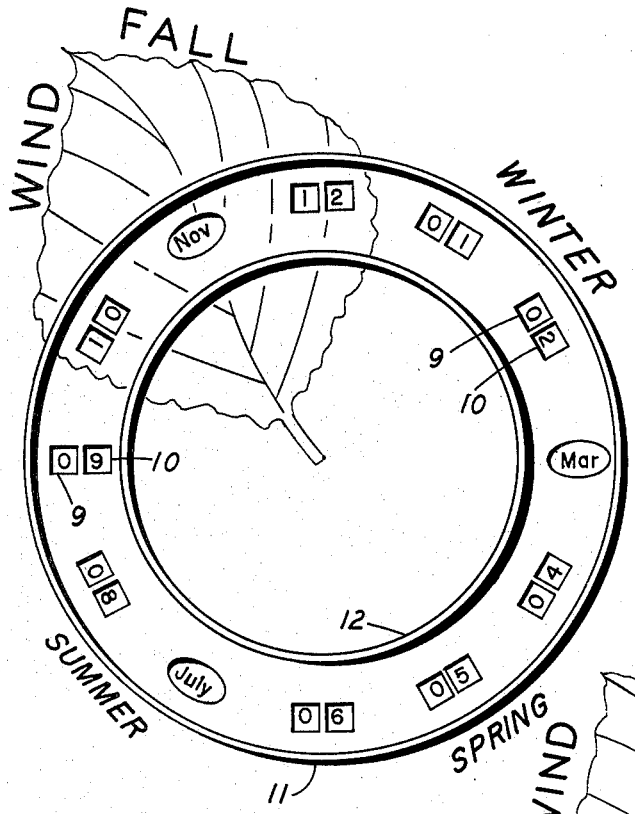

For purposes of this description, we will assume that the player has assessed his position and chosen to proceed with the third round of the draw instead of taking the relatively low payoff available. The next round of payoff consists of the seventh, eighth and ninth draws. Assume that the seventh draw produces 09=September; the eighth draw produces 12=December; and the ninth draw produces 02=February. The player has now made it through the third round of the draw and must be considered quite lucky to have reached this point in the game. He can now post the month combinations which have just been drawn where they belong on the board and after doing so the board will have the appearance shown in FIG. 6.

Figure 7:
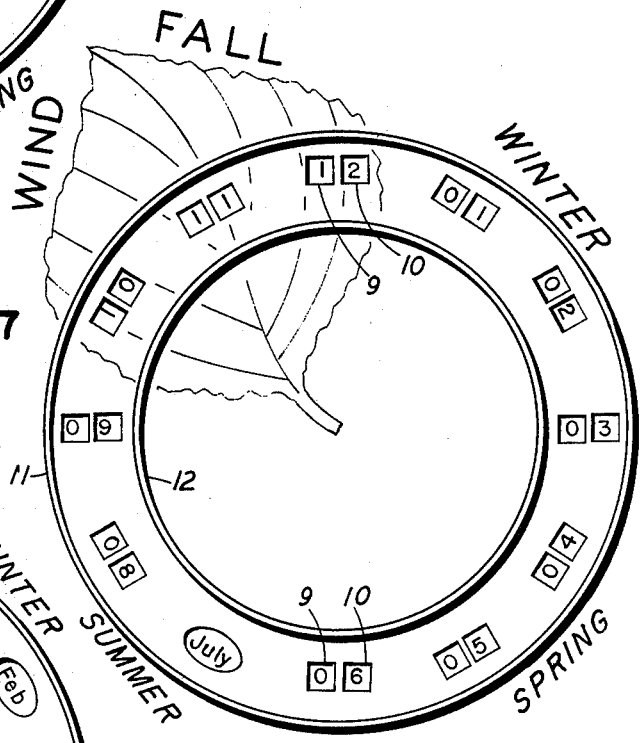

If the player makes the decision to go ahead to win by a "WINDFALL" on the fourth round, he will continue for three additional draws. Assume that the tenth draw produces 03=March; the eleventh draw produces 11=November. That actually would complete the game since the remaining cards would automatically produce 07=July which completes the board. This end position is reached as shown in FIG. 7 of the drawing.

It should be noted that the maximum return on the game is obtained by producing "WINDFALL" which consists of covering the months October, November and December with the numbers 10, 11 and 12, respectively. When this is accomplished, the payoff on the game is the maximum possible. When a WINDFALL is attained by covering the months October, November and December with the numbers 10, 11, 12, respectively, the game automatically ends since the remaining draws must automatically cover all of the numbers outstanding on the board. The WINDFALL position, with the months October, November and December covered with the numbers 10, 11 and 12, respectively, can be reached, however, at different stages in the play of the game and the payoff is progressively larger the earlier in the stage of the game that a WINDFALL is obtained.

In the explanation given so far, a lucky sequence of play was followed in which a WINDFALL position was obtained at the end of the game. A round four WINDFALL can be earned only by the player making it through the first three rounds of the draw and then completing a WINDFALL in the fourth round. In the worst case for a WINDFALL, the months October, November and December would be covered only in the eleventh or twelfth draw. A WINDFALL position could occur at the tenth draw if two of the months consisting of October, November and December were covered during the first three draw rounds and the third month were covered on the tenth draw. When a WINDFALL position is attained on the tenth or eleventh draw, a Level 4 payoff applies.

A round three WINDFALL is even more lucrative than a round four WINDFALL in that the player reaches it on the third draw round and eliminates the need to go on to a fourth draw round to win or loose the game. In this case, the autumn leaf which outlines the months October, November and December is filled by completing the cover of the October, November and December months on the seventh, eighth or ninth draw. Whenever the autumn leaf section is filled in a particular number of draws, a WINDFALL of the magnitude corresponding to the draw round occurs since the remaining months will be automatically covered regardless of the order of draw of the cards.

Figure 8:
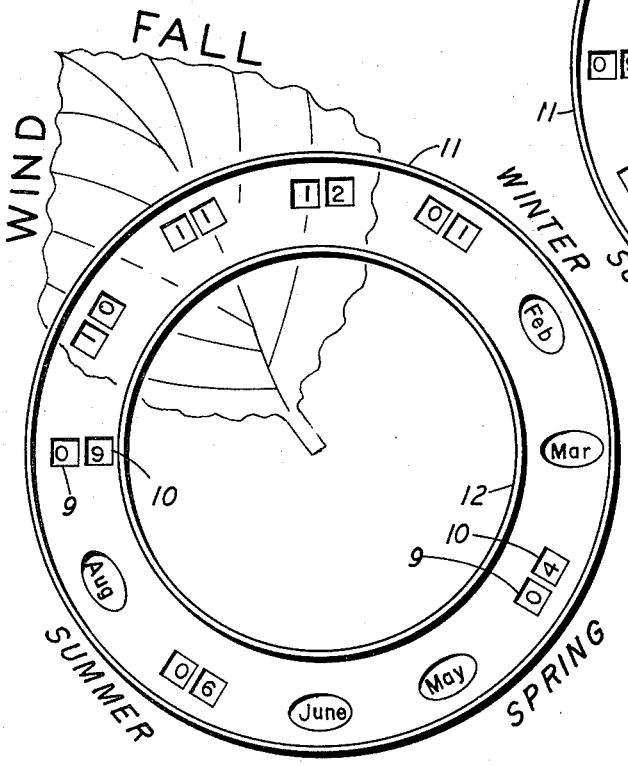
Figure 9:
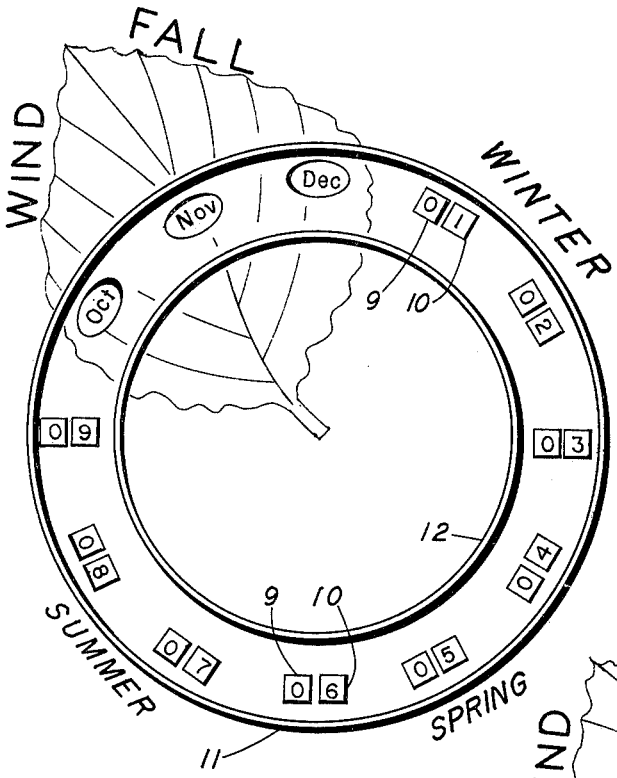
Figure 10:
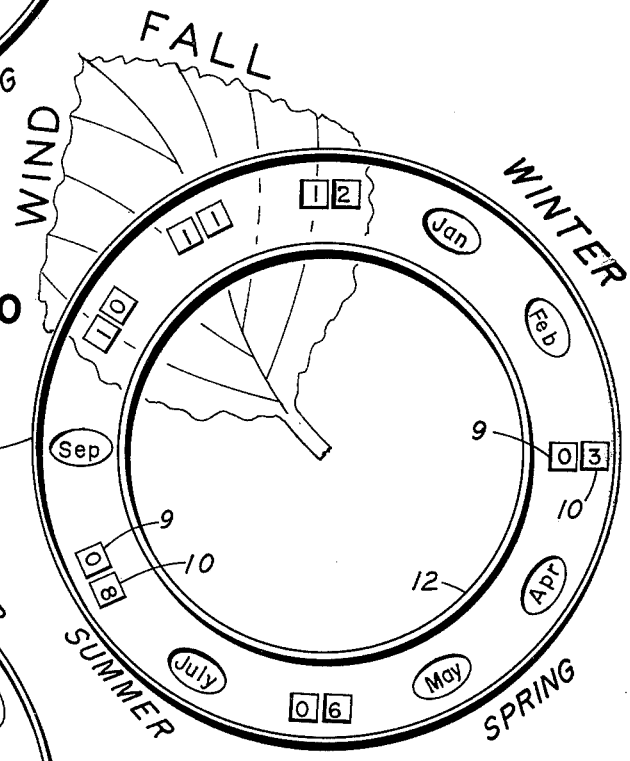
Figure 11:
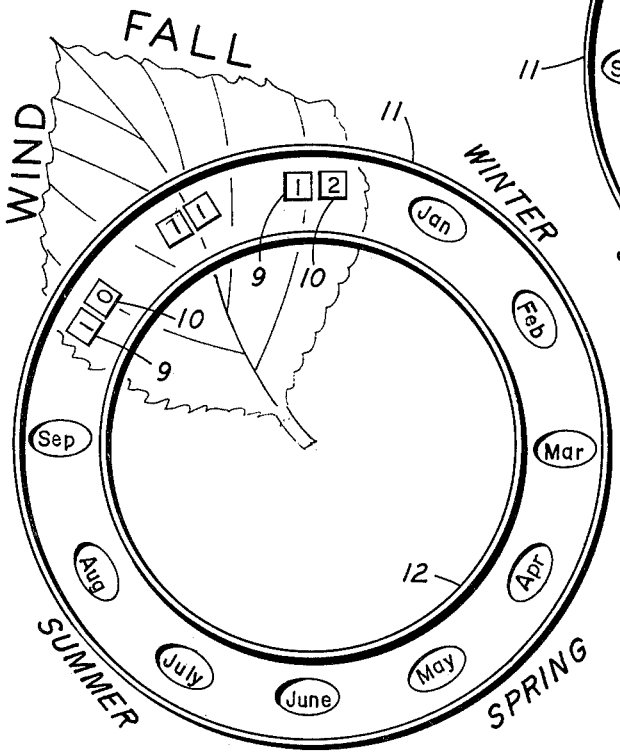

In FIG. 8, the condition of the board illustrates a round three WINDFALL occurring on the seventh draw. In FIG. 9, there is shown a peculiar position which is considered to be the equivalent of a draw round three WINDFALL. This is the position where at the end of the third round all of the months from January through September are covered and none of the months October, November and December are covered. In this position, the WINDFALL months would be automatically covered in the succeeding play and are considered to have been covered and the game completed by reaching this position at the end of the third round. A round two WINDFALL is illustrated in FIG. 10 of the drawings where the months October, November and December are covered by the numbers 10, 11 and 12, respectively, by the end of the sixth draw. The most favorable position of all is the grand slam WINDFALL which occurs on three successive draws as illustrated in FIG. 11. This situation occurs where the initial three draws that the player is committed to make results in his covering the months October, November and December and completing the game at that point. This is the most difficult position to attain, requires the greatest amount of luck, and results in the highest payoff.

Up to this point, the description of the game has focused on the several ways that a player achieve success if he is lucky and can draw to at least the Level 6 payoff. At this point, it is important to understand how a player loses in the game. It has already been pointed out that the player stays in the game as long as he keeps drawing combinations that numercially represent any of the twelve months of the year. The player can lose by drawing a number combination that can not be played. This could represent a number combination that would not represent a month, e.g. 13, 16 or 00. It could also result from a repeat draw of a month that was already covered. To illustrate this situation, if a player draws 00 or a number from 13 to 19 on the first draw he would lose in that position. If he draws one of those numbers on the second draw he would lose, but he would also lose if he drew a number corresponding to a month already played. Thus, if he had played the number combination 01 on January or 02 on February and subsequently drew the combination 01 or 02 he would be unable to play it and would lose the game at that point.

In the play of the game there are several classes of combinations to be considered. First, there are the winning combinations which are always favorable, viz. 03, 04, 05, 06, 07, 08, 09 and 10. These combinations are always favorable because once they are drawn and played for the first time there is no possibility of drawing them again in any of the remaining combinations. The next group of combinations are the losing combinations which would apply to all of the non-month numbers, viz. 00 and 13 through 19. These combinations are always unlucky in view of the fact that they do not represent any of the twelve months of the year and automatically lose the game. The remaining combination of numbers are the numbers 01, 02 and 11 and 12. There are generally good combinations but can be unlucky in certain circumstances. For example, the player may draw one or more of these combinations and play them and then find on a succeeding draw they repeat those number combinations and will lose the game at that point.

The several figures of the drawings ranging from FIG. 4 through FIG. 11 have illustrated different stages in the play of the game and should make it easy to visualize how the game is carried out. The other points described in connection with the winning or losing of the game have filled out the basic rules of how the game is played and how it is won or lost. From this description, it is seen that this game consists of a playing board and two sets of numbered cards which are randomized and played as described above. The game is simple and easy to understand and is interesting and challenging in that offers as opportunity for high return at different stages in play while offering the uncertainty of loss at any particular stage of the draw.

The invention has been described in connection with its use of numbered playing cards and a playing board. Obviously, the same game could be played on any kind of a display panel and with any means for randomizing numbers in the frequency which would be obtained by the card sets that are used herein.

While this invention has been described fully and completely with special emphasis upon a single preferred embodiment, it should be understood that within the scope of the appended claims the invention may be practiced otherwise than as specifically described herein.

I claim:

1. A casino type game of chance comprising a display panel having indicia corresponding to the months of the year, a first chance means for selecting the digits 0 and 1, one at a time, in a random manner, from a group consisting of a nine zeros and three ones, a second chance means for selecting digits, one at a time, in a random manner, from a group consisting of two ones, two twos, and one each of the digits, 0, 3, 4, 5, 6, 7, 8 and 9, each of said chance means being so constructed that subsequent operations thereof in a given sequence of play operate on the respective groups of digits reduced by the digits selected on the preceeding operation or operations until play is terminated and restarted, means for indicating on said display panel the digits selected in a sequence of sequential operations of said first and said second chance means as months of the year according to the number sequence 01=January, 02=February, 03=March, 04=April, 05=May, 06=June, 07=July, 08=August, 09=September, 10=October, 11=November, and 12=December, and play continuing at the option of the player until said first and said second chance means produces a combination of digits forming a number which is not a month or which is a month already played on said display panel.

2. A game according to claim 1 in which said display panel comprises a game board with said indicia of the months thereon.

3. A game according to claim 1 or 2 in which said first and said second chance means also comprises said means for indicating said digits on said display panel or board.

4. A game according to claim 1 or 2 in which said first chance means comprises twelve cards having one digit per card and consisting of nine zeros and three ones, and said second chance means comprises twelve cards consisting of two ones, two twos, and one each of the digits 3, 4, 5, 6, 7, 8, 9, and 0.

5. A game according to claim 1 or 2 in which said first chance means comprises twelve cards having one digit per card and consisting of nine zeros and three ones, said second chance means comprises twelve cards consisting of two ones, two twos, and one each of the digits 3, 4, 5, 6, 7, 8, 9, and 0, and said first named and said second named cards comprising said means for indicating said digit combinations played on said display panel or board.

6. A game according to claim 1 in which said display panel comprises a game board with said indicia of the months thereon and having card holding cubicles therein, said first chance means comprises twelve cards having one digit per card and consisting of nine zeros and three ones, said second chance means comprises twelve cards consisting of two ones, two twos, and one each of the digits 3, 4, 5, 6, 7, 8, 9, and 0, said first named and said second named cards comprising said means for indicating said digit combinations played on said display panel or board, and said cards being removed one at a time from said cubicles for playing on said game board.

7. A game according to claim 6 in which said cubicles extend from side to side of said game board so that said first named and said second named sets of cards may be mixed at random by the game operator and moved through to the player for selection and play.

8. A game according to claim 7 in which at least part of said cards are selected for play by the game operator.

9. A game according to claim 7 in which all of said cards being played are selected by the player.

10. A game according to claim 7 in which said game board comprises two spaced layers with cubicles extending from side to side therethrough.

* * * * *